US005239801A

United States Patent [19]

Adams

[11] Patent Number: 5,239,801

[45] Date of Patent: Aug. 31, 1993

[54] CLIP-ON WOODEN DROP CEILING

[75] Inventor: Joseph E. Adams, Alton, Ill.

[73] Assignee: Wood Ceilings, Inc., Maryland Heights, Mo.

[21] Appl. No.: 925,917

[22] Filed: Aug. 7, 1992

[51] Int. Cl.[5] ..... E04B 9/00

[52] U.S. Cl. ..... 52/484; 52/489; 52/664; 52/665; 52/714

[58] Field of Search ..... 52/484, 712, 489, 780, 52/DIG. 8, 488, 664, 665, 714

[56] References Cited

U.S. PATENT DOCUMENTS

| | | | |
|---|---|---|---|
| 1,507,652 | 9/1924 | Youngberg | 52/484 X |
| 2,767,440 | 10/1956 | Nelsson | 52/488 X |
| 3,094,201 | 6/1963 | Williams | 52/489 |
| 3,212,224 | 9/1965 | Spangenberg | 52/762 X |
| 3,486,311 | 12/1969 | Allan | 52/DIG. 8 X |
| 3,934,387 | 1/1976 | Moeller | 52/489 |
| 4,117,641 | 10/1978 | Wells | 52/489 X |
| 4,189,888 | 2/1980 | Blitzer | 52/316 X |
| 4,333,291 | 6/1982 | Musgrave | 52/486 X |
| 4,452,021 | 6/1984 | Anderson | 52/311 |
| 4,463,537 | 8/1984 | Rodriguez | 52/489 |
| 4,598,521 | 7/1986 | Slapsys | 52/489 X |
| 4,674,254 | 6/1987 | Koehler et al. | 52/484 |
| 4,722,161 | 2/1988 | Young | 52/484 |
| 4,742,662 | 5/1988 | Smith | 52/489 X |
| 5,024,034 | 6/1991 | Gailey | 52/484 |
| 5,081,812 | 1/1992 | Reynolds | 52/484 |

*Primary Examiner*—Richard E. Chilcot, Jr.
*Assistant Examiner*—Beth A. Aubrey
*Attorney, Agent, or Firm*—Don W. Weber

[57] ABSTRACT

A wooden drop ceiling system is provided which is readily attached to an existing metal T-rail system. A uniquely shaped grooved ceiling tile support is clipped on to the existing T-rail supports by means of U-shaped clips. Cross supports are then clipped on to the cross supports of the T-rails and the basic framework for the wooden ceiling tiles is provided. Transition blocks are also attached to the existing T-rail supports at the intersection of the supports and cross supports. Attractive wooden ceiling tiles of various designs and shapes are then placed into the support grids thus creating an attractive and readily installed wooden drop ceiling.

3 Claims, 5 Drawing Sheets

CLIP-ON WOODEN DROP CEILING

This invention relates to the field of indoor ceilings and more particularly to the field of indoor drop ceilings.

It is common in the building trades to replace the existing ceiling with what is called a "drop ceiling". These drop ceilings utilize wire hangers which are attached to the existing ceiling or joists. The other end of the wire hangers are attached to various lightweight metal T-rails. A system of intersecting inverted T-rails is then installed below the regular ceiling. Once this system of intersecting T-rails is installed, ceiling tiles are placed in the square or rectangular patterns thus created to provide a new lower ceiling.

Various types of drop ceilings have been devised in the prior art. One such drop ceiling is described in the 1988 patent issued to Young (U.S. Pat. No. 4,722,161) which describes a modular wood ceiling system. The key to this system is the concealment of the main Ts and cross Ts. The wooden ceiling panels are then positioned above the Ts so as to disguise or conceal the presence of the Ts themselves. This particular type of drop ceiling requires the replacement of the conventional drop ceiling as described above with the new parts for the installation of the modular wood ceiling system described in Young.

Another type of natural wood suspended ceiling system is described in the 1984 U.S. patent issued to Anderson, U.S. Pat. No. 4,452,021. In the Anderson drop ceiling the preferred clip means is fabricated to permit the semi-permanent attachment of individual clips to a suspended grid TEE system and contains a clip leg with extruded wands angling for frictionally coupling decorative molding thereto. The Anderson invention differs from the Instant Invention in that it is a suspension ceiling from a suspension ceiling, unlike the present clip-on wooden drop ceiling. Additionally, the Anderson ceiling requires the use of an additional several inches of space from the existing ceiling so that the Anderson wood drop ceiling is three to four inches below the already suspended T-system drop ceiling.

Some problems in the prior art have dealt with the expense of installing a completely new system to replace an already existing T-type drop ceiling. It is an object of this invention to provide new clip-on rails and cross rails which are readily attached to an existing T-style drop ceiling system.

It is a further object of this invention to provide a new type of wooden drop ceiling system which does not require use of any of the valuable space between an existing drop system ceiling and the new ceiling to be installed.

It is a still further object of this invention to provide a unique decorative wooden drop ceiling system to replace the standard metal/ceiling tile system currently in use in the building industry.

Other and further objects of this invention will become apparent upon reading the following Specification.

BRIEF DESCRIPTION OF THE INVENTION

This invention involves a unique second rail system which is conveniently attached to an existing first metal T-rail system. The support for the wooden decorative ceiling tiles are a number of grooved ceiling tile supports which may be quickly and conveniently clipped to the existing metal T-rail ceiling support system. Cross supports are also conveniently clipped to the cross metal T-rail drop ceiling supports so as to create the standard square or rectangular pattern. At the intersection of the rails and cross-rails, square blocks are also clipped to the metal T-rail to create a more pleasing appearance. Once the grooved ceiling tile supports, cross supports and square blocks are attached to the existing T-rail drop ceiling system, decorative wooden ceiling tiles may be suspended by the ceiling tile supports and cross supports. The completed drop ceiling system is nearly the same distance from the floor as the existing metal T-rail drop ceiling system but the presence of a decorative wood tile and supports provides a much more aesthetically pleasing and attractive ceiling while not sacrificing the height of the ceiling from the floor.

DETAILED DESCRIPTION OF THE PREFERRED EMBODIMENT

Figure 1:
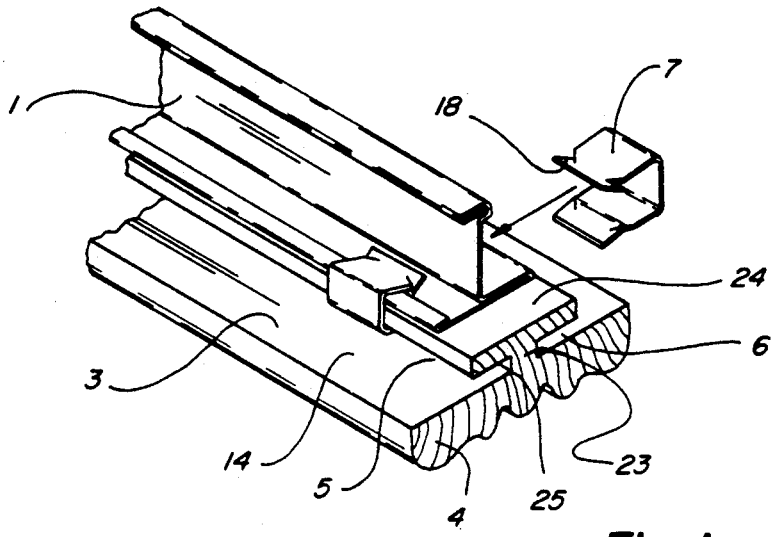
FIG. 1 is a partial perspective view of the existing T-rail, ceiling tile support, and attaching clip.
Figure 2:
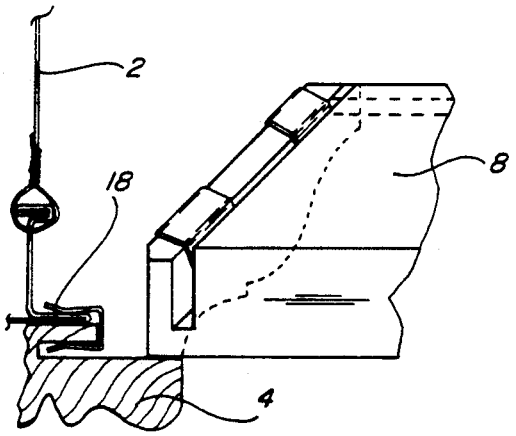
FIG. 2 is a partial view of the system in place showing the existing T-rail system, the grooved ceiling tile support, and a wooden ceiling tile.

The normal type of metal T-rail drop ceiling system is shown in partial view in FIGS. 1 and 2. This type of T-rail system involves a T-rail 1. The Tee is inverted as shown in FIGS. 1 and 2. The Tee is attached to the ceiling by means of a wire 2. The upper portion of the wire 2 is attached to the ceiling while the lower portion of the wire 2 is attached to the Tee as shown in FIG. 2. The Tee is initially designed to support the ceiling tile for the standard drop ceiling system.

This new invention described herein utilizes the existing T-rail system and T-rails 1 but attaches a grooved ceiling tile support 3 to the existing inverted Tee by means of the attaching clips 7, as shown in FIGS. 1 and 2.

The grooved ceiling tile support 3 has a unique shape so as to be adaptable to attachment to the inverted existing Tee 1. The grooved ceiling tile support 3 has a lower attractive decorative portion 4 which may have the design as shown on FIG. 1. Obviously, many other types of decorative designs may be utilized in practicing this invention and the particular decorative design shown on FIGS. 1 and 2 is meant for means of illustration only and not as a limitation.

Figure 8:
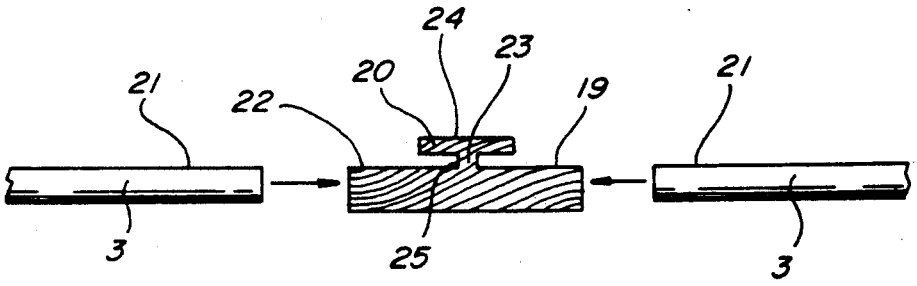
FIG. 8 is a side view of the block/rail intersection.

An integral and important part of the grooved ceiling tile support is the upper attaching Tee 5. This upper attaching Tee 5 comprises a vertical leg 23 and a horizontal leg 24. The lower end 25 of the Tee 5 is manufactured as a one-piece construction with the lower decorative portion 4 of the support or cross support (FIG. 1) or transition block (FIG. 8). This upper attaching Tee has a grooved ceiling tile support attaching groove 6, as best shown in FIG. 1.

In order to attach the grooved ceiling tile support 3 and cross supports 3' (FIG. 3) to the standard T-rail 1, the upper attaching Tee 5 is placed directly beneath the horizontal portion of the existing T-rail. These two portions are clipped together as shown in FIGS. 1 and 2. The irregularly shaped clip 7 is preferably a square U-shape with outer prongs 18 near the outer edge of the clip as shown on FIG. 1. These outer prongs 18 help to secure the grooved ceiling tile support to the existing T-rail and to insure that the pieces do not slip. The grooved ceiling tile supports 3 are attached along the corresponding T-rail supports. Cross supports 3' (shown in FIG. 5) are then attached to the cross T-rails to complete the grid pattern.

Figure 9:
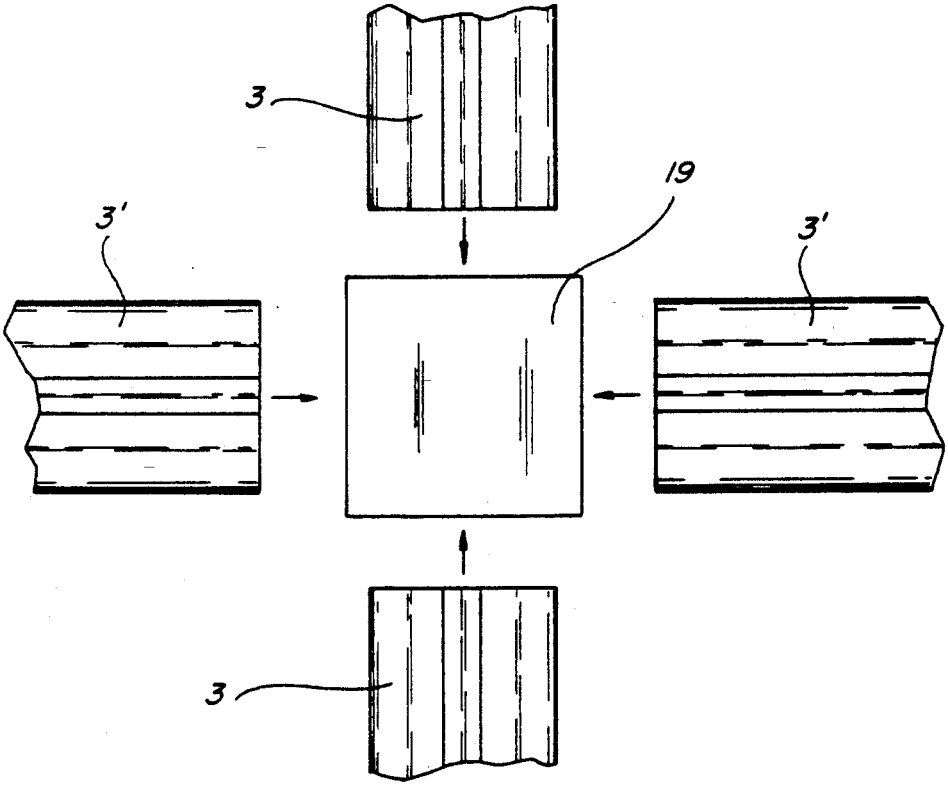
FIG. 9 is an exploded view looking towards the ceiling showing the intersection of the rails, cross-rails and square blocks.
Figure 10:
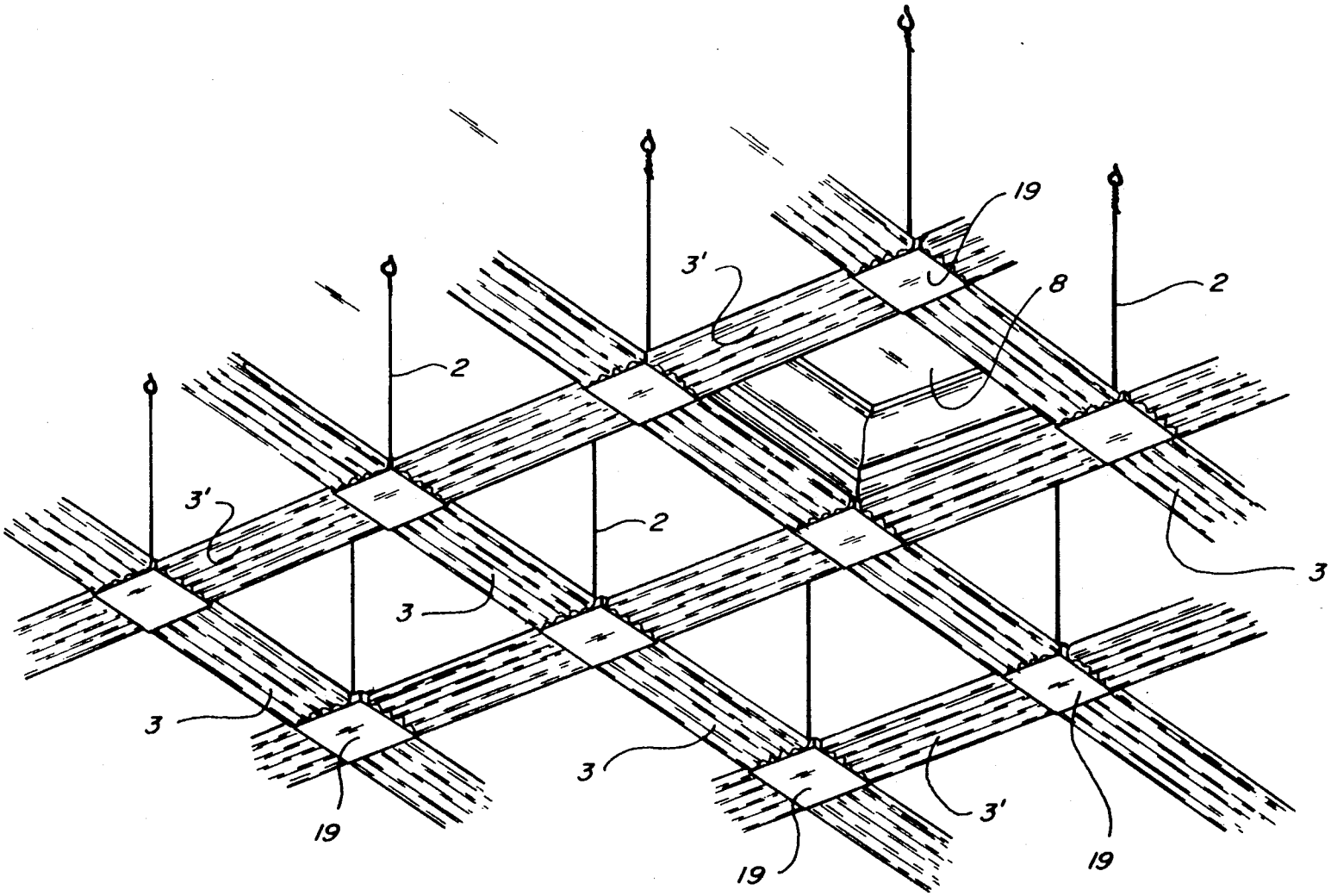
FIG. 10 is a detail perspective view of the intersection of a transition block and supports and cross supports.

At the intersection of the rails 3 and cross-rails 3' are attached a transition square block 19. This rosette block 19 has a shape similar to the rails, but is essentially square, as best shown on FIGS. 8 and 9. The block 19 has a wider cross-section than the cross-section of the rails, as shown on FIG. 8. In practice the upper edge 21 of the rails and cross-rails is even with the upper edge 22 of the block. The presence of this block 22 at the intersection of the rail lengths 3 and cross-rail lengths 3' adds to the attractiveness of the ceiling. The blocks 19 are attached to the metal T-rail by means of the block upper attaching Tee 20 and the attaching clips 7. The lower surface of the blocks may be smooth, as shown or decorative similar to the lower decorative portion 4 of the rails.

Once the grid pattern is completed, the decorative wooden ceiling tile sections 8 are then placed above and supported by the tile supports 3 and 3' and blocks 19 to complete the wooden drop ceiling.

It is also necessary in a drop ceiling of this nature to have grooved ceiling tile supports around the perimeter walls of the room. This is accomplished by means of the grooved side wall tile support 11 best shown in FIG. 3.

Figure 3:
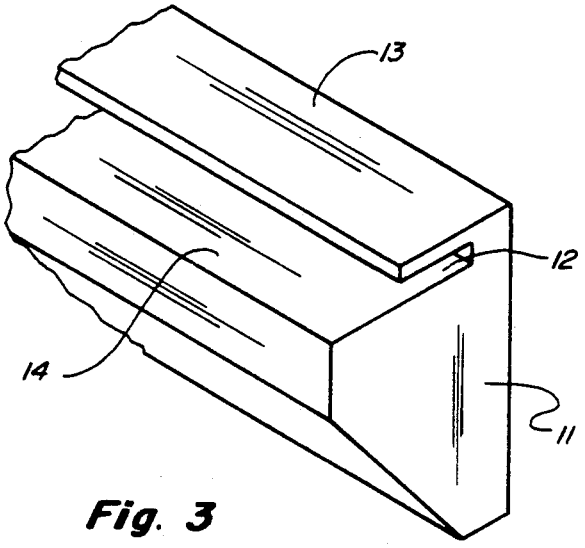
FIG. 3 is a perspective view of the grooved sidewall tile support.
Figure 4:
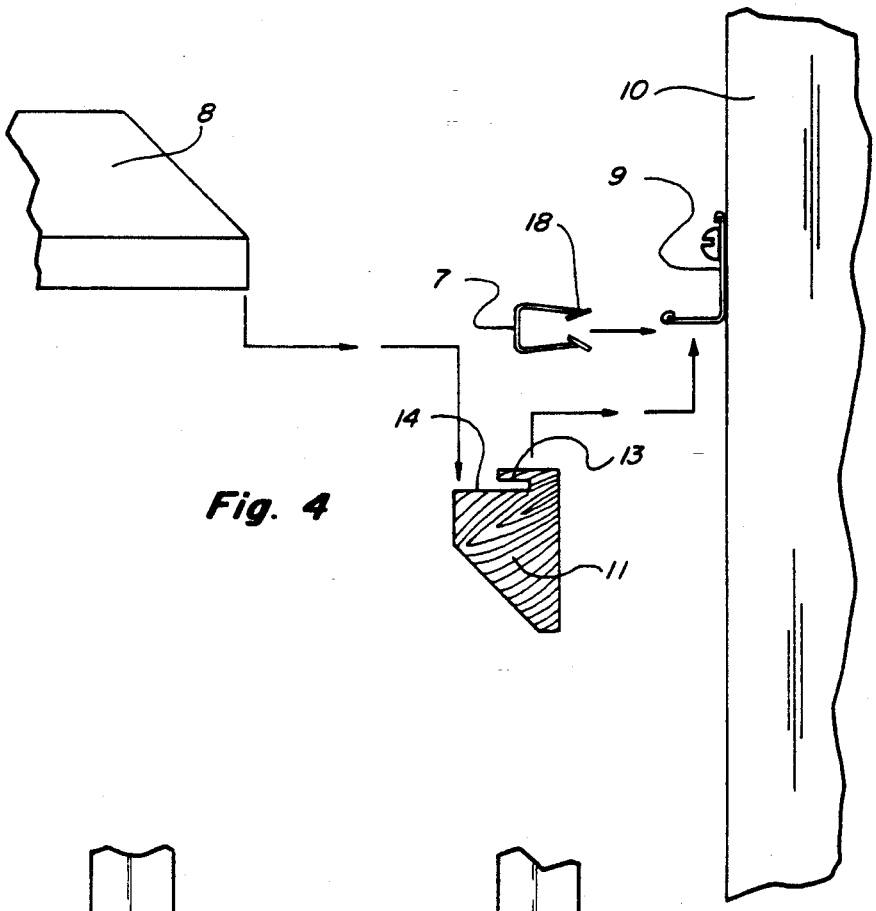
FIG. 4 is a side exploded view of the side wall support, clip and wooden ceiling tile shown in relation to a side wall.

In the standard T-rail drop ceiling system, an L-rail 9, shown in FIG. 4, is attached to the side wall 10 of the room by means of screws or other attachments. This L-rail is part of the installation of the standard metal drop ceiling system. In order to attach the grooved side wall tile support 11 to the L-rail 9, the same attaching clip 7 with the attaching clip outer prongs 18 is used. The grooved side wall tile support 11 has a side wall support attaching groove 12 and an upper attaching lip 13 as shown in FIG. 3.

The grooved sidewall tile support 11 is placed so that the upper attaching lip 13 is directly beneath the horizontal section of the L-rail. The attaching clip 7 is then utilized to attach the horizontal portion of the L-rail to the upper attaching lip 13. Once these grooved side wall tile supports 11 are attached around the perimeter of the room, the protruding tile support flange 14 is then available to support the wooden ceiling tile 8 as best shown on FIG. 4.

Figure 6:
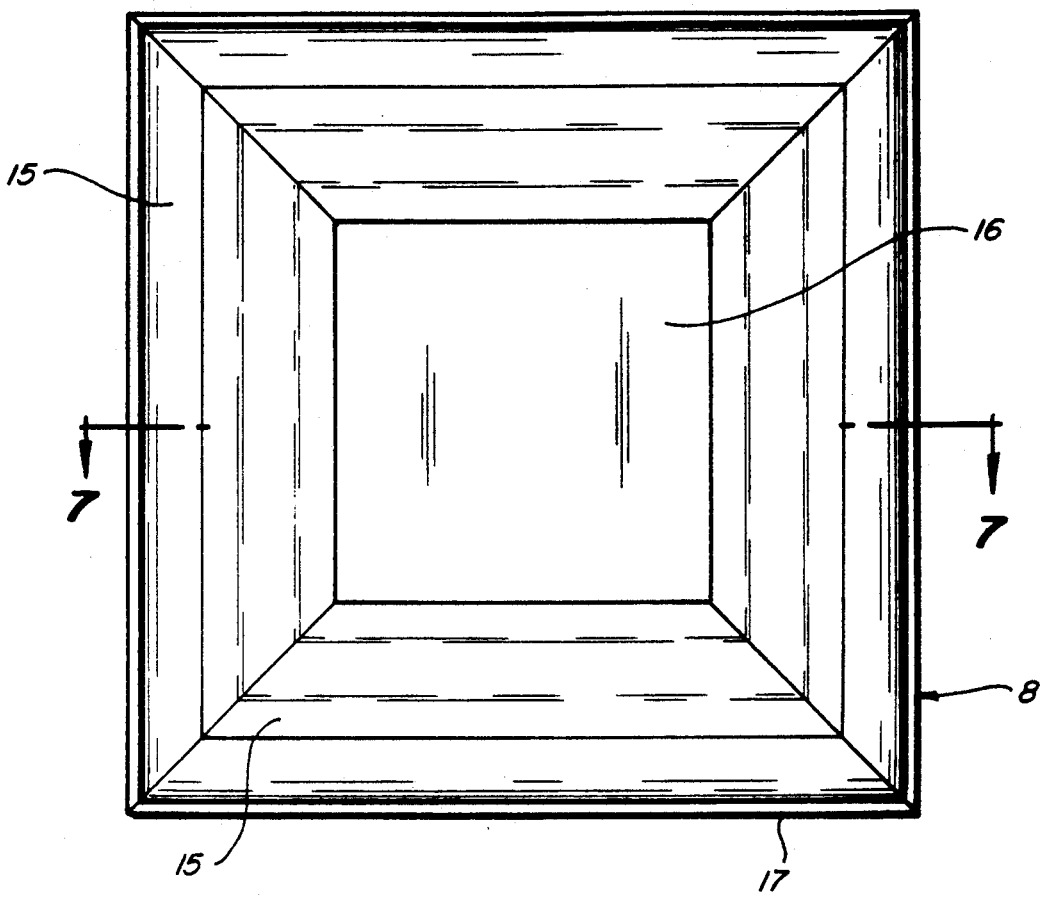
FIG. 6 is a planar view of the wooden ceiling tile as seen from the floor looking up to the ceiling.
Figure 7:
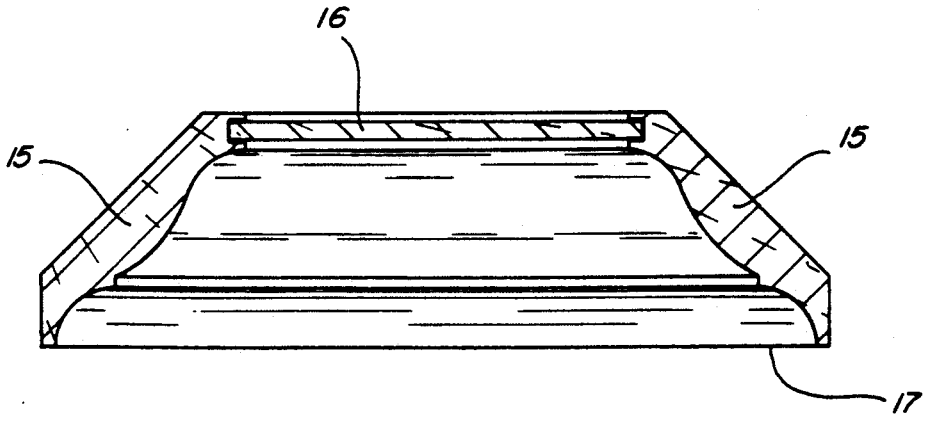
FIG. 7 is a cross sectional view of the wooden ceiling tile showing its frustro-pyramidal shape.

Turning now to the decorative features of the ceiling tile, we see that the ceiling tile 8 may be of any type of aesthetic or pleasing design. The particular design shown here is a frustro-pyramidal design as best shown in FIGS. 6 and 7. The ceiling tile has sloped sides 15 and a top 16. This particular design for the wooden ceiling tile 8 is meant as means of illustration only and not as a limitation. The wooden tile could easily be rectangular or square, depending on the placement of the cross supports 3'. Each tile 8 has outer edges 17 as shown on FIGS. 5 and 7.

Figure 5:
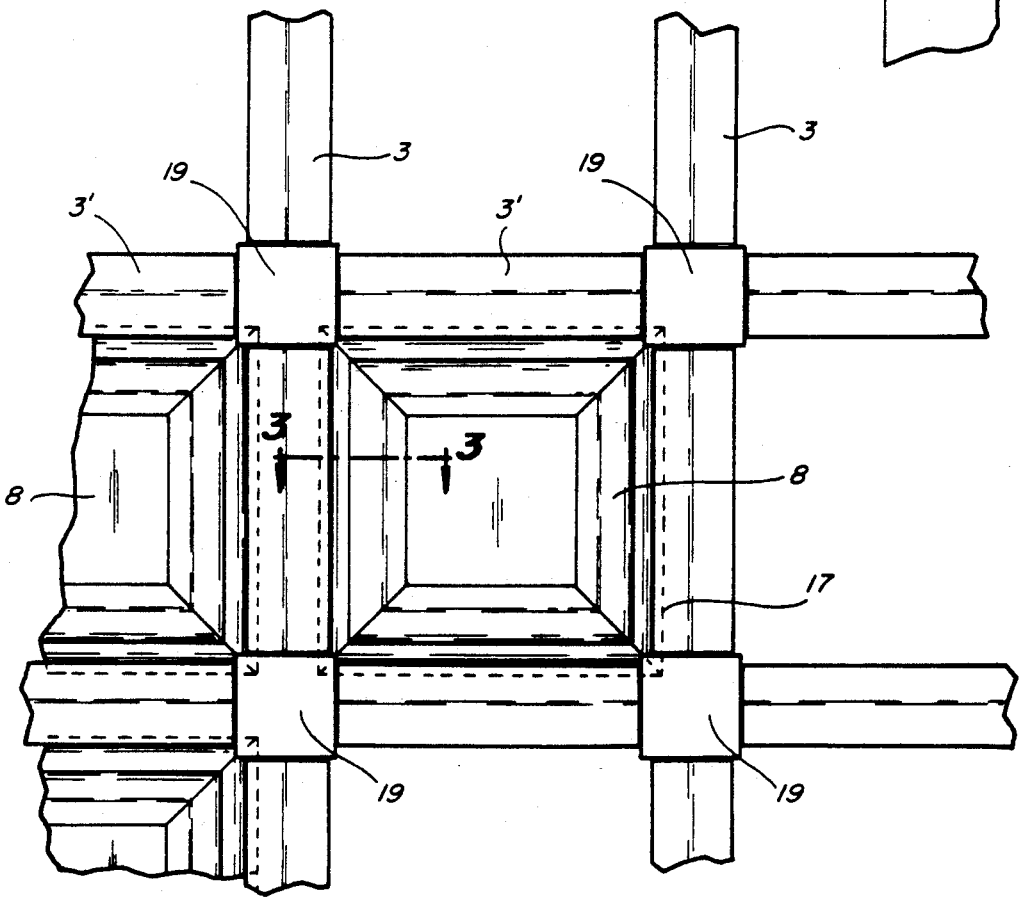
FIG. 5 is a view looking directly upwards towards the ceiling showing the ceiling tile support and cross support as well as ceiling tiles in place.

As shown in FIG. 5, the square ceiling tile is easily placed into the square sections formed by the grooved ceiling tile supports 3, cross supports 3', and blocks 19. A series of these supports, cross supports and blocks may form either rectangular or square openings for either rectangular or square wooden ceiling tiles 8. While the attractive frustro-pyramidal ceiling tile as shown in FIGS. 6 and 7 is utilized herein, different shapes of wooden ceiling tiles may be utilized in practicing this invention.

One of the main advantages of this particular invention is the ease of installation. In installing this particular drop ceiling utilizing wooden tiles, an existing metal T-rail system may be quickly changed to a beautiful and more attractive wooden tile system by use of the grooved ceiling tile supports and clips. The ceiling may be readily and easily installed. Because the bottom of the T-rail and the top of the attaching lip or Tee for the grooved ceiling tile support are adjacent to another, very little space is taken from the bottom of the drop ceiling to the floor.

Having fully described my invention, I claim:

1. A wooden drop ceiling system adaptable to an existing metal inverted T-rail system, comprising:

(a) grooved ceiling tile supports having a lower decorative portion and an upper T-shaped attaching portion wherein said upper T-shaped portion comprises a vertical leg having its lower end continuous with said lower decorative portion and a horizontal leg continuous with the upper end of said vertical leg;

(b) grooved ceiling tile cross-supports having a lower decorative portion and an upper T-shaped attaching portion wherein said upper T-shaped portion comprises a vertical leg having its lower end continuous with said lower decorative portion and a horizontal leg continuous with the upper end of said vertical leg;

(c) grooved transition blocks located at the intersection of the supports and cross supports having a lower decorative portion and an upper T-shaped attaching portion wherein said upper T-shaped portion comprises a vertical leg having its lower end continuous with said lower decorative portion and a horizontal leg continuous with the upper end of said vertical leg;

(d) U-shaped attaching clips which attach the horizontal leg of the upper T-shaped attaching portion of the supports, cross-supports and transition blocks to the existing inverted T-rail;

(e) decorative panels which are supported by means of said grooved ceiling tile supports, cross-supports and transition blocks.

2. A wooden drop ceiling system adaptable to an existing metal inverted T-rail system as in claim 1, wherein said attaching clips are U-shaped having outer securing prongs thereon.

3. A wooden drop ceiling system adaptable to an existing metal inverted T-rail system as in claim 1, further comprising grooved side wall tile supports having an upper horizontal attaching lip and a lower decorative portion, said side wall supports being attached to the existing side wall support by means of attaching clips.

* * * * *